United States Patent [19]

Rath, deceased et al.

[11] Patent Number: 4,653,696

[45] Date of Patent: Mar. 31, 1987

[54] ELECTROSTATIC SPRAY GUN FOR COATING MATERIAL

[76] Inventors: Anton Rath, deceased, late of Markdorf; by Margrit Rath, heir, Torkelhalden 6, D-7788 Markdorf, both of Fed. Rep. of Germany

[21] Appl. No.: 834,218

[22] Filed: Feb. 27, 1986

[30] Foreign Application Priority Data

Mar. 6, 1985 [DE] Fed. Rep. of Germany ..... 3507965

[51] Int. Cl.[4] ..... B05B 5/02

[52] U.S. Cl. ..... 239/708; 239/73; 239/289; 361/228

[58] Field of Search ..... 239/691, 704–708, 239/289, 71, 73; 361/227, 228

[56] References Cited

U.S. PATENT DOCUMENTS

| | | | |
|---|---|---|---|
| 2,697,411 | 12/1954 | Ransburg | 239/704 |
| 3,641,971 | 2/1972 | Walberg | 239/691 |
| 4,287,552 | 9/1981 | Wagner et al. | 239/708 |
| 4,437,614 | 3/1984 | Garcowski | 239/704 |
| 4,441,656 | 4/1984 | Huber | 239/708 |

*Primary Examiner*—Joseph F. Peters, Jr.
*Assistant Examiner*—Michael J. Forman
*Attorney, Agent, or Firm*—Ostrolenk, Faber, Gerb & Soffen

[57] ABSTRACT

An electrostatic spray gun having an electrode for applying an electrostatic charge to coating material. A lever is provided for controlling both the flow of material from the spray gun as well as the position of a first magnet. The first magnet, in turn, controls a first magnetically actuatable electric switch for connecting and disconnecting a high voltage to the electrode. A second magnetically actuatable electric switch, controlled by the position of a second magnet, is electrically connected in series with the first switch, so that the high voltage can be disconnected from the electrode regardless of the position of the actuating lever. The spray gun can therefore be operated with or without the application of an electrostatic charge to the coating material.

8 Claims, 2 Drawing Figures

ELECTROSTATIC SPRAY GUN FOR COATING MATERIAL

BACKGROUND OF THE INVENTION

The present invention relates to an electrostatic spray gun for coating material and, more particularly to an electrostatic spray gun having an actuating lever for controlling both the flow of coating material and the electrostatic charging of coating material.

Electrostatic spray guns typically employ an electrode for applying an electrostatic charge to coating material as it flows through the spray gun and exits from an atomizer nozzle of the spray gun. In certain circumstances, it is desirable to atomize the coating material without applying an electrostatic charge. For example, when coating a narrow cavity, the application of an electrostatic charge would cause much of the coating material to be deflected laterally because the electric field would not penetrate into the cavity. As a result, most of the coating material could concentrate on the outer edges of the cavity and only a small amount of coating material would enter into the cavity. It is, therefore, desirable to be able to control the electrostatic charging of the coating material.

Typically, the control of electrostatic charge in spray guns is effected by a magnetically actuatable electric switch which can connect or disconnect an electric power supply to the electrode. Magnetically actuatable electric switches consist of so-called "reed" switches in which a pair of electrical contacts are contained in a small glass tube and can be opened or closed by the application of an external magnetic field. A magnetically actuatable switch is necessary for electrostatic spray guns because many coating materials are explosive and could be ignited by the sparks generated by the opening and closing of an ordinary switch.

Electrostatic spray guns often employ a single lever to control both the flow of coating material through the spray gun as well as the application of electrostatic charge to the coating material. In such spray guns, the coating material supply line is opened and the electric power supply to the electrode is connected, either simultaneously or in succession, as the actuating lever is moved. In the latter case, when the connection is effected in succession, the spray gun is often designed so that partial movement of the actuating lever will actuate the spraying of coating material, but not the magnetically actuatable electric switch, so that the electrode is not connected to the electric power supply, and the sprayed coating material is not electrostatically charged. In such a device, the operator must approximate how far to move the lever in order to actuate spraying of the coating material without connecting the high voltage to the electrode. The operator must therefore be skillful and experienced. Moreover, the fine touch required by this design can become quite tedious for even the most skilled operator.

The spray gun disclosed in U.S. Pat. No. 4,441,656 overcomes this problem. In this device, a first magnet is employed for producing a magnetic field to actuate a magnetically actuatable electric switch, and a second magnet is employed to produce a second magnetic field which, by appropriate adjustment of the second magnet, can be superimposed over the first magnetic field so that the switch is continuously open, i.e. so that the electrode is not connected to high voltage regardless of the position of the actuating lever and the corresponding position of the first magnet. The second magnet of this device can be adjusted independently of the position of the actuating lever.

The energy supply circuit of electrostatic spray guns typically consists of a high-voltage transformer coupled to a high-voltage multiplier circuit. Such an arrangement is disclosed, for example, in U.S. Pat. No. 3,608,823. The magnetically actuatable electric switch is located in the electric supply line on the primary side of the transformer.

SUMMARY OF THE INVENTION

The present invention is directed at increasing the dependability of operation over prior devices. In the present invention, the high-voltage supply to the electrode can be disconnected independently of the position of the actuator, i.e. the actuating lever, by a second magnet that can be located at any desired place on the spray gun, regardless of the location of the magnetically actuatable electric switch and the first magnet.

This object is achieved in accordance with the invention by the actuator, in the form of a lever, which both causes delivery of coating material to an outlet and operates the first magnet or completing the electric supply circuit to the electrode for charging the coating material and by the electric power supply circuit having a second magnetically actuatable electric switch associated with second magnet which opens or closes the circuit, while the flow of coating material to the outlet nozzle continues.

Further features and advantages of the present invention are described below with reference to the accompanying drawings.

DESCRIPTION OF THE PREFERRED EMBODIMENT

Figure 1:
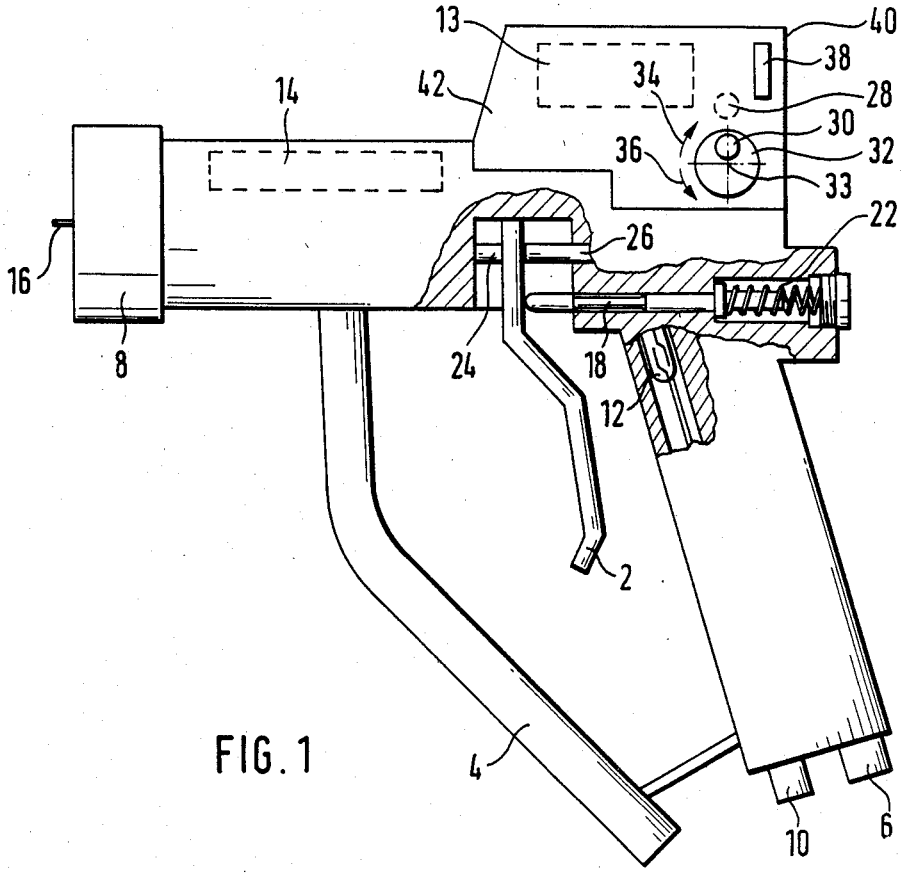
FIG. 1 is a diagrammatic view, partially in section, of an electrostatic spray gun constructed in accordance with the invention.

Referring first to FIG. 1 of the drawings, the electrostatic spray gun of the present invention has an external housing and has an actuating lever 2 pivotally supported to the housing and movable for opening and closing the supply of coating material through a coating material supply line 4. The coating material may consist, for example, of a liquid lacquer which is atomized though a nozzle 8 by compressed air supplied through a gas channel 6 on the handle of the spray gun. Instead of lacquer, powdered coating material could also be atomized, in which case the two lines 4 and 6 could be replaced by only one line through which the powdered coating material would be pneumatically conveyed. Electric power supply line 10 contains an electric switch 12 in the form of a reed switch. Switch 12 can be magnetically switched by a magnetic field to connect and disconnect the supply of current to a transformer 13, which feeds the high-voltage generating circuit 14. The high-voltage generating circuit 14 is preferably a voltage multiplication circuit, such as one disclosed, for example, in U.S. Pat. No. 3,608,823. High-voltage generating circuit 14 produces a high-voltage, for instance 140,000 volts, which is applied to one or more electrodes 16 which electrostatically charge the coating material.

Alongside switch 12, at a slight distance from it, is positioned a permanent bar magnet 18. Magnet 18 is displaced axially by the actuator, which is in the form of an actuating lever 2, which is moved against the force of a spring 22. In FIG. 1, switch 12 is shown in the open position. When actuating lever 2 is moved inward, switch 12 moves to a position where the magnetic field of the magnet closes the switch contacts of the switch 12. Depending on the intended purpose of use, the spray gun can be designed so that actuating elements 24 and 26 open the valves in lines 4 and 6 for the feeding of coating material and gas simultaneously with the closing of the contacts in switch 12. Alternatively, the spray gun may be designed so that the valves are opened before the closing of switch 12, or so that the valves are opened only after the closing of switch 12.

A second magnetically actuatable electric switch 28 is provided between the first switch 12 and the transformer 13 which is actuated by a magnet 30 arranged in a knob 32 eccentrically to the axis of rotation 33 thereof. As shown in FIG. 1, by turning the knob 32 in clockwise direction, as indicated by arrow 34, the second magnet 30 is brought near the second switch 28, so that switch 28 is closed by the magnetic field of second magnet 30. If first switch 12 is now closed by moving actuating lever 2, then current from electric power supply line 10 passes through the two switches 12 and 28 to the transformer 13, which, in turn, supplies a high voltage to electrode 16. If the second magnet 30 is rotated into a position away from the second switch 27 by turning the knob 32 in counterclockwise direction, as indicated by the arrow 36, then the contacts of second switch 28 open and the supply of current to the transformer 13 is thereby interrupted, regardless of the position of actuating lever 2 and regardless of the switch position of first switch 12. In this way, electrode 16 is not supplied with a high voltge, regardless of the position of actuating lever 2.

The magnets 18 and 30 of the two switches 12 and 28 are preferably permanent bar magnets. The second magnet 30 of the second switch 28 is positioned so that its longitudinal axis is parallel to the axis of rotation 33 of knob 32. As a variant of the embodiment shown, the second magnet 30 could also be fastened to a slide instead of being arranged in knob 32.

A voltage-indicating device in the form of a light-emitting diode 38 is connected to the primary side of the transformer 13 at the rear portion 40 of the spray gun. Light-emitting diode 38 is illuminated when electrode 16 is supplied with high voltage.

The knob 32, the second magnet 30, the second switch 28, the light-emitting diode 38, and the transformer 13 are all located in a separate housing 42.

Figure 2:
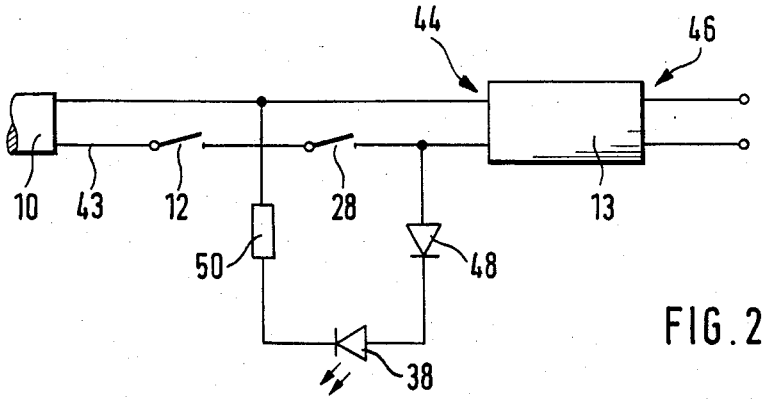
FIG. 2 shows a portion of the high-voltage supply circuit of the spray gun of FIG. 1.

FIG. 2 shows the electrical circuit diagram for the present invention. The two switches 12 and 28 are arranged in series in line 43 of the electric power supply line 10 on the primary side 44 of the transformer 13, the voltage multiplication circuit 14 of FIG. 1 (not shown in FIG. 2) being connected to the secondary side 46 of transformer 13. The light-emitting diode 38 is connected on the primary side of transformer 13, at one side between switches 12 and 28 and the transformer 13, and, on the other side, between the electric power supply line 10 and transformer 13. A rectifier 48 and a resistor 50 are connected in series with light-emitting diode 38.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. An electrostatic spray gun for coating material, comprising:

a housing; an atomizer nozzle; a coating material supply line leading to said atomizer nozzle;

at least one electrode at said nozzle for applying an electrostatic charge to the coating material;

a first magnetically actuatable electric switch for connecting and disconnecting an electric power supply to said electrode;

a first magnet for producing a magnetic field which actuates said first switch; an actuator for moving said first magnet between a first postion proximal to said first switch and a second position distal to said first switch for actuating said first magnet and for opening and closing said coating material supply line;

a second magnetically actuatable electric switch electrically connected in series with said first switch; and a second magnet for producing a magnetic field which actuates said second switch;

means for moving said second magnet between a position proximal said second switch and a position distal said second switch;

said first switch and said first magnet being located at spaced apart locations from said second switch and said second magnet to enable independent actuation;

whereby said second switch can be actuated by said second magnet to disconnect an electric power supply from said electrode regardless of the position of said actuator and the flow of coating material from said spray gun.

2. A spray gun as recited in claim 1, wherein said first and second magnets are permanent bar magnets.

3. A spray gun as recited in claim 1, wherein said means for moving said second magnet comprises a knob.

4. A spray gun as recited in claim 1, further comprising a voltage indicating device for indicating the supply of voltage from the power supply to said electrode.

5. A spray gun as recited in claim 4, wherein said voltage-indicating device is a light-emitting diode.

6. A spray gun as recited in claim 5, wherein said second switch, said second magnet, and said high-voltage transformer are disposed in a separate housing in the first mentioned housing.

7. A spray gun as recited in claim 1, further comprising a high-voltage transformer for serving as a supply of high voltage to said electrode, said first and second switch being disposed on a primary side of said transformer.

8. A spray gun as recited in claim 1, wherein said actuator comprises a lever supported for moving said first magnet into a position for actuating said first switch and a position for deactivating said first switch.

* * * * *